US011751620B2

(12) United States Patent
Hur

(10) Patent No.: US 11,751,620 B2
(45) Date of Patent: Sep. 12, 2023

(54) DECORATIVE KNOT AND ARTICLE OF APPAREL OR HEADWEAR INCORPORATING SAME

(71) Applicant: Annie International, Inc., North Wales, PA (US)

(72) Inventor: Kenneth Hur, Warrington, PA (US)

(73) Assignee: Annie International, Inc., North wales, PA (US)

( * ) Notice: Subject to any disclaimer, the term of this patent is extended or adjusted under 35 U.S.C. 154(b) by 23 days.

(21) Appl. No.: 17/544,566

(22) Filed: Dec. 7, 2021

(65) Prior Publication Data

US 2023/0172299 A1 Jun. 8, 2023

(51) Int. Cl.
*A42B 1/041* (2021.01)
*A42B 1/004* (2021.01)
(Continued)

(52) U.S. Cl.
CPC ..... *A42B 1/041* (2013.01); *A42B 1/004* (2013.01); *A42C 5/00* (2013.01)

(58) Field of Classification Search
CPC ..... A42B 1/041; A42B 1/004; A42B 1/16; A42B 1/04; A42B 1/049; A42B 1/24; A42B 1/248; A42B 1/00; A42B 1/018; A42B 1/02; A42B 1/14; A42B 1/002; A42B 1/012; A42B 1/019; A42B 1/045; A42B 1/12; A42B 1/205; A42C 5/00; A41D 27/08; A41D 27/00; A41D 23/00; A41D 25/02; A41D 25/022; A41D 19/0051; D04D 7/00; D04D 7/04; D04D 7/06; D04D 9/00; D04D 9/04; A44C 1/00; A44C 25/00; A44C 27/00; A41G 1/00
(Continued)

(56) References Cited

U.S. PATENT DOCUMENTS 112,906 A * 3/1871 Davis ..... B68B 5/00 428/4
215,275 A * 5/1879 Heimann ..... A42C 1/02 223/12
(Continued)

FOREIGN PATENT DOCUMENTS

CA 2774091 A1 * 10/2013 ..... A42C 5/02
GB 327284 A * 4/1930
GB 2249710 A * 5/1992 ..... A42B 1/12

*Primary Examiner* — Amy Vanatta
(74) *Attorney, Agent, or Firm* — Howson & Howson LLP

(57) ABSTRACT

A decorative knot for a turban or other article of apparel comprises a flexible core composed of solid polyethylene foam and having a uniform circular cross section. A length of polyester fabric fits over, and covers, the exterior surface of the core material and includes two overlapping layers extending laterally from the core material and sewn together. The fabric-covered core material is formed into a spiral consisting of multiple turns proceeding around an axis. The turns have a progressively increasing radius and are progressively axially displaced from one another. Adjacent turns of the spiral touch, and are sewn to one another. The overlapping layers of fabric that are sewn together extend inward toward the axis of the spiral and the decorative knot is secured to the turban by stitches that pass through the portion of the overlapping layers of fabric that extend inward from the largest turn of the spiral.

13 Claims, 4 Drawing Sheets

(51) Int. Cl.
*A42B 5/00* (2006.01)
*A42C 5/00* (2006.01)

(58) Field of Classification Search
USPC ..... 2/244; 428/4, 5, 7, 11
See application file for complete search history.

(56) References Cited

U.S. PATENT DOCUMENTS 623,032 A * 4/1899 Penny ..... A42B 1/002 2/175.4
660,529 A * 10/1900 Johnson ..... A42B 1/22 2/200.1
1,139,418 A * 5/1915 Hiller ..... A42B 1/12 D2/868
1,611,621 A * 12/1926 Weil ..... D04D 7/10 428/5
1,749,340 A 4/1930 Grean
1,831,169 A * 11/1931 Geraldine ..... D04D 7/06 160/349.2
2,168,765 A * 8/1939 Dowd ..... A42B 1/041 D2/889
2,302,226 A * 11/1942 Josephs ..... A42B 1/04 2/181
2,414,665 A * 1/1947 Podolsky ..... A42B 1/041 D2/880
2,456,352 A * 12/1948 Whitney ..... A42B 5/00 2/171
2,817,090 A 12/1957 Toellner
3,452,364 A * 7/1969 Langston ..... A42B 1/04 2/171.02
3,456,657 A * 7/1969 Smith ..... A42B 1/041 D2/870
3,471,867 A * 10/1969 Kirchhoff ..... A41D 23/00 132/273
3,510,881 A * 5/1970 Lester ..... A42B 1/04 2/200.1
3,587,114 A 6/1971 McCourtie
4,343,047 A * 8/1982 Lazowski ..... A42B 3/125 2/909
10,959,471 B2 3/2021 Roemer
2014/0202482 A1 * 7/2014 Didieu ..... A45D 8/36 132/200
2017/0112217 A1 * 4/2017 Diamond ..... A42B 1/004

* cited by examiner

DECORATIVE KNOT AND ARTICLE OF APPAREL OR HEADWEAR INCORPORATING SAME

FIELD OF THE INVENTION

This invention relates to a decorative knot for use as a component of an article of apparel, for example, a head covering known as a turban, worn by a woman either as a fashion article or for personal care.

BACKGROUND OF THE INVENTION

Turbans have been worn by men for many years, in most cases for religious reasons. More recently, turbans have been used by women to protect their hair while sleeping or while engaged in activities that tend to disturb their hair. Many women also use turbans as fashionable portions of their wardrobes.

Especially in the case in which the turban is worn as fashion item, it is typically formed with a decorative knot. In some cases, the turban is suppled in the form of a length of fabric which is wrapped around the head one or more times and tied by the wearer to form the knot. In other cases, the turban is formed in such a way that it can be simply fitted onto the wearer's head without the need for tying. In the latter cases, a pre-formed decorative knot is typically included as a component of the turban. The decorative knot can be a unitary part of the fabric that forms the head covering. Alternatively, the head covering can be formed with a loop, and a separate, elongated piece of fabric is passed through the loop and then tied to form a decorative knot.

The version in which the user ties the knot is deficient in that it is difficult for a user to tie a suitable decorative knot. The version in which the turban is supplied with a pre-formed knot is similarly deficient in that it is difficult to form a suitable decorative knot from a unitary part of the fabric of the head covering, and it is also difficult to form a suitable decorative knot from an elongated piece of fabric passed through a loop formed in the head covering.

SUMMARY OF THE INVENTION

An object of this invention is to provide an attractively appearing decorative knot that can be formed readily and inexpensively, and that can be readily attached to a head covering or other article of apparel.

The decorative knot in accordance with the invention comprises a length of flexible core material, preferably a length of solid polyethylene foam having a uniform circular cross section. A length of fabric, preferably a polyester fabric, fits over, and covers, the exterior surface of the length of core material from one end to the opposite end. The fabric may include two overlapping layers extending laterally from the length of core material and sewn together. The fabric-covered length of core material is formed into a spiral consisting of multiple turns proceeding around an axis. The turns have a progressively increasing radius and are progressively axially displaced from one another. Adjacent turns of the spiral touch, and are secured to, one another, preferably by sewing. The overlapping layers of fabric that are sewn together preferably extend inward toward the axis of the spiral from the length of core material. The decorative knot can be secured to a article of headwear or another article of apparel by stitches that pass through the portion of the overlapping layers of fabric that extend inward from the largest turn of the spiral.

DETAILED DESCRIPTION OF THE PREFERRED EMBODIMENTS

Figure 1:
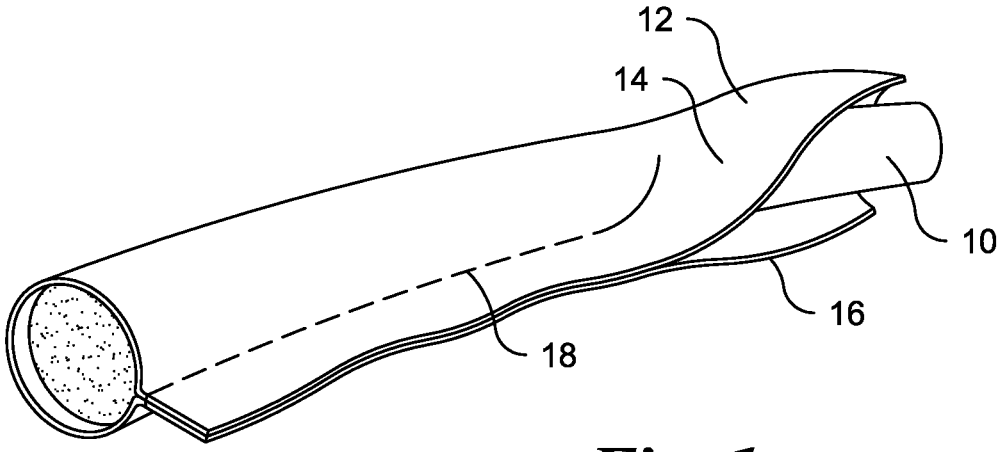
FIG. 1 is a fragmentary perspective view illustrating the stitching of the fabric cover to a length of the flexible foam core.

FIG. 1 shows a length of flexible core material 10, preferably composed of a solid polyethylene foam and having a uniform circular cross-section. In the process of assembling the decorative knot, an elongated strip 12 of fabric, preferably a woven polyester fabric, is wrapped around the core material 10 so that it covers the exterior surface of the core material from one end to the other. The length of the strip of fabric is preferably such that it extends beyond the ends of the length of core material so that the ends of the core material can also be covered by parts of the fabric strip.

The width of the fabric strip 12 preferably exceeds the circumference of the core so that overlapping layers 14 and 16 of the fabric can be sewn together by a line of stitches 18 extending lengthwise along the fabric strip adjacent the core 10. The overlapping fabric layers can be secured to each other by machine stitching.

Figure 2:
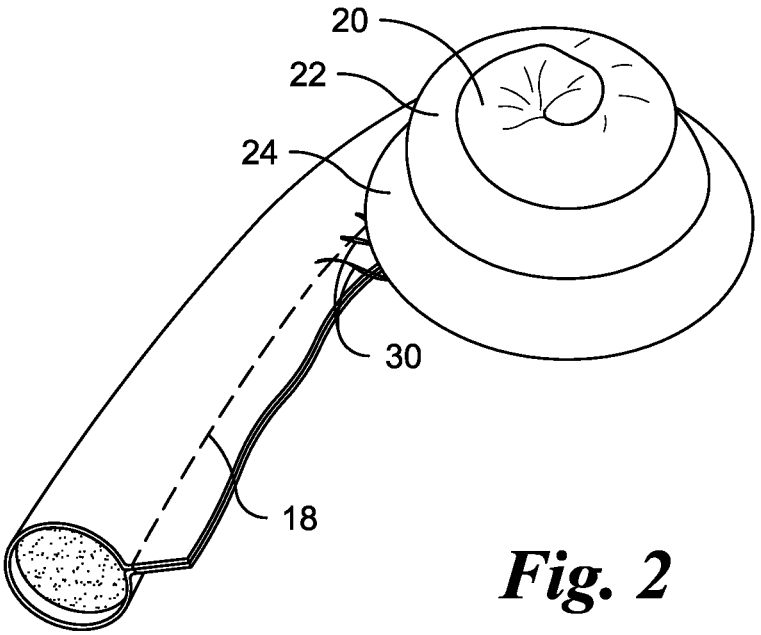
FIG. 2 is a perspective view illustrating the formation of the fabric-covered foam core into a three-dimensional spiral.
Figure 3:
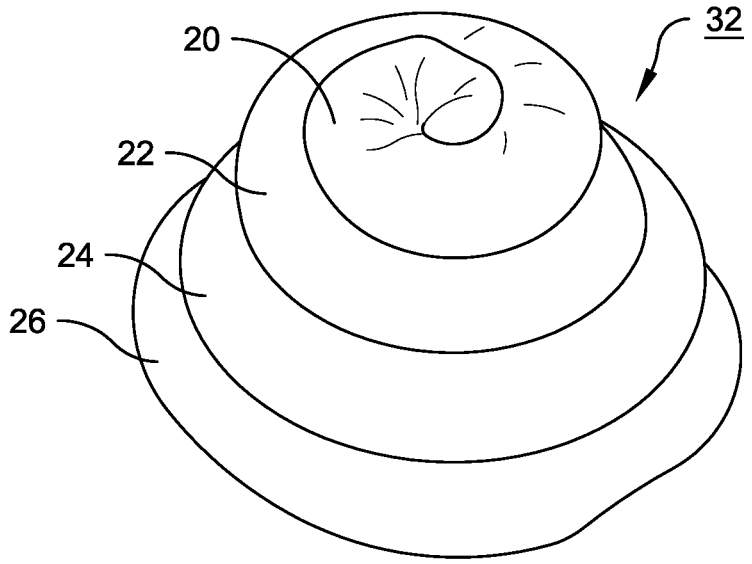
FIG. 3 is a perspective view of the completed knot.
Figure 4:
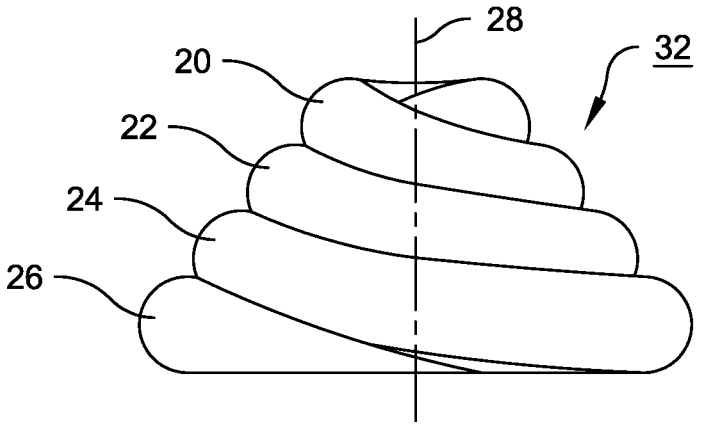
FIG. 4 is an elevational view of the completed knot, showing its relationship to an axis of the spiral.

As shown in FIGS. 2, 3 and 4, after the fabric strip is secured to the foam core along the entire length of the core, the fabric-covered length of core material is formed into a spiral. The spiral consist of multiple turns, including, for example, turns 20, 22, 24, and 26, which extend around an axis 28 shown in FIG. 4. The turns have a progressively increasing radius and are progressively displaced from one another along the direction of axis 28. Adjacent turns touch, and are secured to, one another by stitches 30, as shown in FIG. 2. These stitches 30 are hand-sewn, and can pass through the parts of the fabric strip covering the foam core, or through a part of the strip covering the foam core in one turn, and through the overlapping fabric layers of an adjacent turn.

The completed knot 32, shown in FIGS. 3 and 4 is composed of four turns. However, the knot can be composed of more, or fewer, than four turns.

Figure 5:
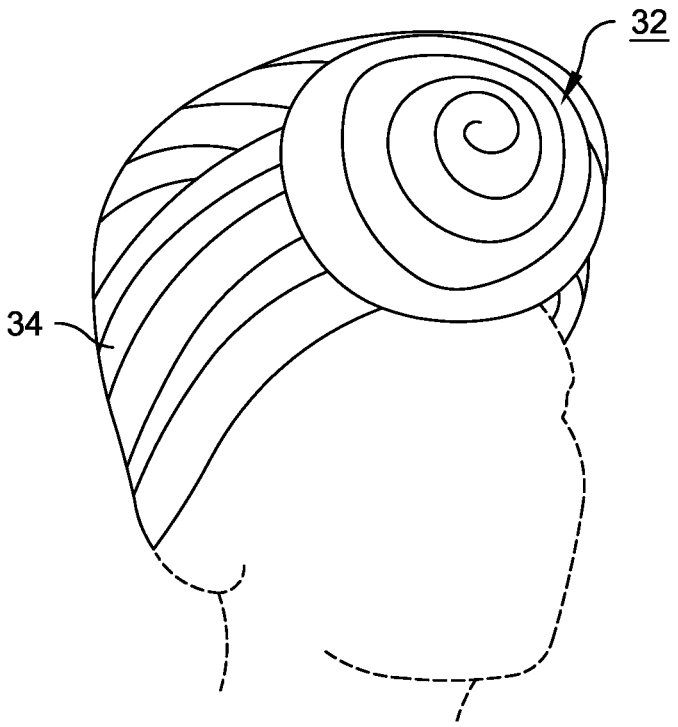
FIG. 5 is a perspective view showing the completed knot attached to the head-covering portion of a turban.

FIG. 5 shows the completed knot 32 secured to the front portion of a turban 34.

Figure 6:
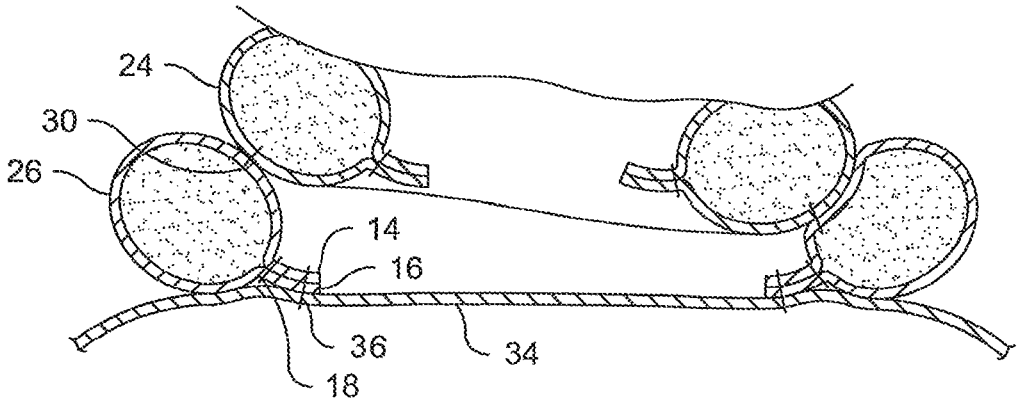
FIG. 6 is a cross-sectional view showing stitching by which the knot is secured to a turban or other article of apparel.

The cross-sectional view in FIG. 6 shows the overlapping fabric layers 14 and 16 overlying the fabric of the turban 34 and secured to the turban fabric by stitching 36. The knot can be secured to the fabric layer of the turban or other article of apparel in other ways, for example, by stitches sewn through the fabric surrounding the foam core rather than through the overlying fabric layers.

Various other modifications can be made to the knot depicted in the drawings. For example, the core can be composed of a material other than a foam, and its cross-sectional shape can be other than circular, e.g., elliptical or polygonal. These and other modifications that will occur to persons skilled in the art can be made to the knot described herein without departing from the scope of the invention as defined in the following claims.

What is claimed is:

1. An article of apparel comprising a layer of fabric at least a part of which is adapted to cover a portion of an individual's body and including a decorative knot secured to said layer of fabric, the knot comprising:

a length of flexible core material having an exterior surface extending from one end to an opposite end of said length of flexible core material; and a length of fabric fitting and covering the exterior surface of said length of core material;

wherein the fabric-covered length of core material is formed into a spiral consisting of multiple turns proceeding around an axis, said turns have a progressively increasing radius, and are progressively axially displaced from one another, and adjacent turns of said multiple turns touch, and are secured to, one another; and wherein said multiple turns of said fabric-covered length of core material are disposed in opposed, overlying, relationship to said part of said layer of fabric.

2. The article of apparel according to claim 1, wherein said adjacent turns of said multiple turns are sewn together.

3. The article of apparel according to claim 1, wherein said flexible core material is composed of a solid foam.

4. The article of apparel according to claim 1, wherein said flexible core material is composed of a solid polyethylene foam.

5. The article of apparel according to claim 1, wherein said length of fabric is a polyester fabric.

6. The article of apparel according to claim 1, wherein the length of fabric includes overlapping layers extending laterally from said length of core material and sewn together, and wherein said adjacent turns of said multiple turns are sewn together.

7. The article of apparel according to claim 1, wherein the length of fabric includes overlapping layers extending laterally from said length of core material and sewn together, wherein said adjacent turns of said multiple turns are sewn together, and wherein said overlapping layers extend inward from said flexible core material toward said axis.

8. An article of headwear comprising a quantity of fabric, shaped to fit onto the upper portion of a human head, and including a decorative knot secured to said fabric, the knot comprising:

a length of flexible core material having an exterior surface extending from one end to an opposite end of said length of flexible core material; and a length of fabric fitting and covering the exterior surface of said length of core material;

wherein the fabric-covered length of core material is formed into a spiral consisting of multiple turns proceeding around an axis, said turns have a progressively increasing radius and are progressively axially displaced from one another, and adjacent turns of said multiple turns touch, and are secured to, one another; and wherein said multiple turns of said fabric-covered length of core material are disposed in opposed overlying, relationship to a portion of said quantity of fabric.

9. The article of headwear according to claim 8, wherein said adjacent turns of said multiple turns are sewn together.

10. The article of headwear according to claim 8, wherein said flexible core material is composed of a solid foam.

11. The article of headwear according to claim 8, wherein said flexible core material is composed of a solid polyethylene foam.

12. The article of headwear according to claim 8, wherein the length of fabric includes overlapping layers extending laterally from said length of core material and sewn together, and wherein said adjacent turns of said multiple turns are sewn together.

13. The article of headwear according to claim 8, wherein the length of fabric includes overlapping layers extending laterally from said length of core material and sewn together, wherein said adjacent turns of said multiple turns are sewn together, and wherein said overlapping layers extend inward from said flexible core material toward said axis.

* * * * *